United States Patent [19]

Muller

[11] Patent Number: 4,744,727

[45] Date of Patent: May 17, 1988

[54] CONTROLLABLE PITCH PROPELLER AND WATERCRAFT DRIVE

[76] Inventor: Peter Muller, Widmerstrasse 27, Zurich, Switzerland

[21] Appl. No.: 883,101

[22] Filed: Jul. 8, 1986

Related U.S. Application Data

[63] Continuation-in-part of Ser. No. 649,373, Sep. 11, 1984, Pat. No. 4,599,043.

[30] Foreign Application Priority Data

Sep. 22, 1983 [CH] Switzerland ..... 5159/83

[51] Int. Cl.[4] ..... B63H 3/08

[52] U.S. Cl. ..... 416/93 A; 416/164; 416/167

[58] Field of Search ..... 416/93 A, 93 R, 162, 416/164, 166, 167, 93 M, 134 R, 169 C, 146 B

[56] References Cited

U.S. PATENT DOCUMENTS

| | | | |
|---|---|---|---|
| 2,082,059 | 6/1937 | Irgens | 416/93 A |
| 2,306,096 | 12/1942 | Vose | 416/93 X |
| 2,383,440 | 8/1945 | Baxter | 416/167 |
| 2,742,097 | 4/1956 | Gaston | 416/167 X |
| 3,000,447 | 9/1961 | Baugher | 416/166 X |
| 3,073,395 | 1/1963 | Duncan | 416/220 A X |
| 3,338,313 | 8/1967 | Tolley et al. | 416/169 C X |
| 3,406,759 | 10/1968 | Nutku | 416/167 |
| 3,482,261 | 12/1969 | Sorrentino | 416/167 X |
| 3,600,102 | 8/1971 | Dirlik | 416/166 |
| 3,764,228 | 10/1973 | Shook | 416/93 A |
| 3,790,304 | 2/1974 | Langlois | 416/93 A X |
| 3,853,427 | 12/1974 | Holt | 416/167 |
| 3,958,897 | 5/1976 | Connolly | 416/166 |
| 4,417,852 | 11/1983 | Costabile et al. | 416/93 A |
| 4,599,043 | 7/1986 | Müller | 416/162 |
| 4,648,847 | 3/1987 | Mueller | 416/166 X |

FOREIGN PATENT DOCUMENTS

| | | | |
|---|---|---|---|
| 154954 | 9/1985 | European Pat. Off. | 416/166 |
| 382091 | 1/1908 | France | 416/167 |
| 418288 | 2/1947 | Italy | 416/166 |

*Primary Examiner*—Everette A. Powell, Jr.
*Attorney, Agent, or Firm*—Helfgott & Karas

[57] ABSTRACT

A controllable pitch propeller assembly has an inner housing attached to a main drive shaft, the housing having rails on the outer surface thereof. Modules carrying the propeller blades are positively mounted on the rails, each module having a housing receiving a hub cylinder and bushings axially aligned at opposite sides thereof. Each pair of bushings receives an adjusting piston having an adjusting pin which engages a groove forming a control path in a propeller hub. Each blade is adjusted by a control lever which adjusts each adjusting piston through a mechanical linkage including an adjusting sleeve and a thrust bearing and flange. The hub is provided with open spaces formed between the inner and outer housings to create hub through exhaust ducts.

14 Claims, 3 Drawing Sheets

CONTROLLABLE PITCH PROPELLER AND WATERCRAFT DRIVE

This invention relates to a controllable pitch propeller assembly and to a watercraft and is a continuation-in-part of Ser. No. 649,373 filed Sept. 11, 1984, now U.S. Pat. No. 4,599,043.

BACKGROUND OF THE INVENTION

Controllable pitch propellers are used to a considerable extent on watercraft, particularly ships. Variation in the propeller pitch facilitates maneuvering and permits an optimum propeller blade setting for the selected speed and power of the propeller drive motor.

Some sort of the power system is necessary for setting the pitch of the propeller blades. A manual adjustment device can only be used in connection with very small controllable pitch propellers bacause, with larger propellers, it is simply not possible to manually alter the propeller pitch while the vessel is being driven because of the large forces involved. Known adjustment devices include a lever operable from the vessel which acts on an adjustment sleeve mounted on the outflow side of the propeller hub and on which is arranged a thrust bearing forming a transition to the rotary system, i.e. the rotating propeller blades.

In the propulsion system of a larger ship, hydraulic adjustment drive systems can be used in which a single hydraulic cylinder causes the adjustment of the propeller pitch. A pressure medium, usually hydraulic oil, is necessary for the adjustment and fixing of the propeller blades and is introduced into the hub by means of a supply line while the used pressure medium, is led back through a return line. In such a hydraulic circuit, the transition from the stationary to the rotary portion of the controllable pitch propeller constitutes a problem area at which leakage losses can occur. However, additional leakage losses can also occur in the hub and the leaking pressure medium cannot be collected and returned. Thus, the hydraulic oil passes out into the water and becomes a source of pollution.

A completely hydraulic adjustment device of this general type is reliable but is costly and can only be economically installed on large ships.

On smaller ships and particularly on motorboats, the controllable pitch propeller has only been used to a limited extent because of the aforementioned problems.

The advantage of the fixed propeller is its simple design and the small dimensions of its housing. In a well-known solution, the housing of a fixed propeller is additionally employed for drawing off exhaust gases from the drive motor or engine for the watercraft. If the fixed propeller is replaced by a controllable pitch propeller, there is the disadvantage, that the mechanism for adjusting the pitch of the propeller blade is situated in the housing and therefore prevents the provision of several open spaces in the propeller hub for drawing off exhaust gases.

BRIEF SUMMARY OF THE INVENTION

Accordingly an object of the present invention is to provide a controllable pitch propeller assembly, which can be employed especially on smaller ships and which permits to draw off the exhaust gases of the motor or engine for the watercraft through open spaces in the propeller housing.

Briefly described the invention includes a controllable pitch propeller for driving a watercraft having a main drive shaft, outer housing means attached to the shaft for rotation herewith, a plurality of propeller blades, each having a propeller hub pivotably attached to said outer housing means, so that the pivoting of each said hub adjusts the pitch of its associated blade, an inner housing connected to the outer housing means, open spaces formed between the outer housing means and the inner housing which extend through the length of the outer housing means.

BRIEF DESCRIPTION OF THE DRAWINGS

In order that the manner in which the foregoing and other objects are attained in acoordance with the invention can be understood in detail, particularly advantageous embodiments thereof will be described with reference to the accompanying drawings, which form a part of this specification, and wherein.

DETAILED DESCRIPTION OF THE PREFERRED EMBODIMENTS

Figure 2:
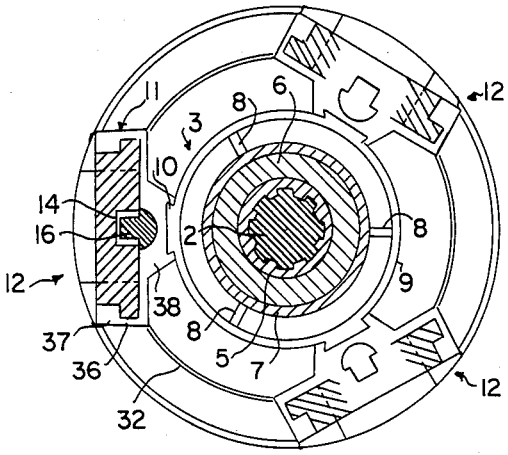
FIG. 2 is a transverse sectional view along line II—II of FIG. 1.
Figure 1:
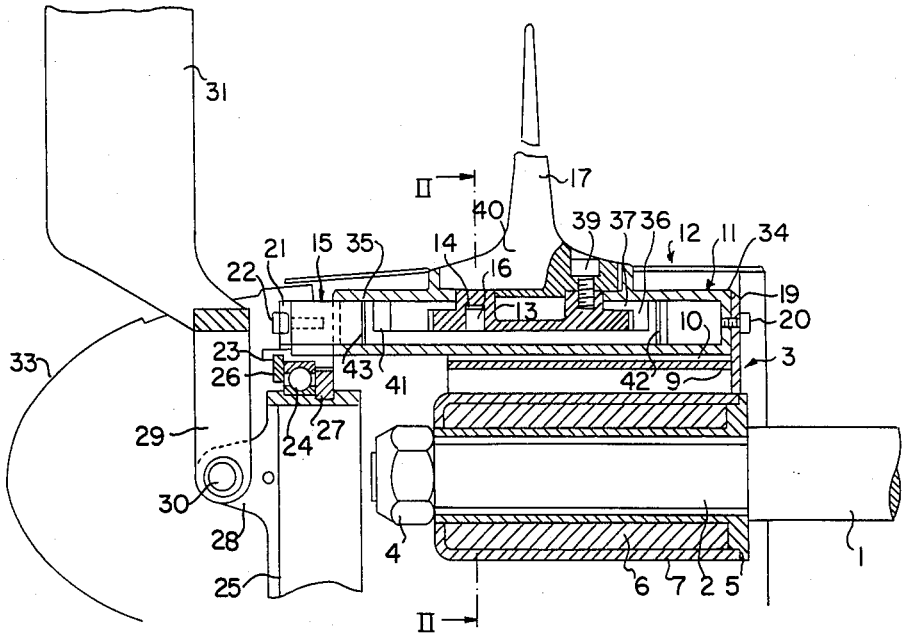
FIGS. 1 is a partial side elevation, partly in section, of a controllable pitch propeller assembly in accordance with the invention.

As shown in FIG. 1, a propeller assembly in accordance with the invention includes a main drive shaft 1 which is coupled to the source of propulsion, for the watercraft, shaft 2 having a splined end portion 2 on which is mounted an inner housing indicated generally at 3, the housing being attached to the shaft by a nut 4. The inner housing 3 is a generally cylindrical body having a splined sleeve 5 surrounded by and embedded in an elastic sleeve 6 which is, in turn, surrounded by a metal sleeve 7. Three axially extending radial webs 8 (FIG. 2) are attached to and extend outwardly from sleeve 7 and support a bearing sleeve 9. A plurality of support rails 10 are uniformly distributed around the outer circumference of bearing sleeve 9 and, as shown in FIG. 2, have a dovetail cross section. Each support rail 10 forms a support for an outer housing 11 which is part of an outer housing module 12. Taken together, the modules 12 form an outer housing means for supporting the propeller blade each housing 11 being shaped to receive a propeller hub 13 which has a transverse groove 14 defining a control path. Housing 11 also receives an adjusting piston 15 which has a prottruding adjusting pin 16, which projects into control path 14. It will be observed that each module 12 is essentially independent in the sense that any number of such modules can be used depending upon whether 2, 3 or 4 propeller blades 17 are to be provided. It is merely necessary for the inner housing 3 to be provided with a suitable number of rails 10 corresponding to the number of modules 12 and blades 17 and, in addition, to conform the diameter of bearing sleeve 9 to the requirements of the particular structural arrangement. Internal housing 3 and modules 12 form a space-saving light-weight construction making it possible to use similar propeller hub diameters to those used with propeller assemblies having fixed blades. The hub structure consisting of housing 3, and modules 12, can be covered by a light-weight external hub 18 which does not need to absorb large forces and can consequently be made from a light-weight material such as plastic.

For absorbing the axial thrust which occurs, inner housing 3 has a front wall 19 which supports modules 12 which are held in position by screws 20.

The individual blades 17 are jointly adjusted. Thus, pistons 15 are interconnected at one end by an annular adjusting flange 21 which is connected to the pistons 15 by screws 22. On the inner side of flange 21 is a generally cylindrical connecting piece 23 which forms the seat for the outer race of an axial roller bearing 24, the inner race of which is mounted on an generally cylindrical adjusting sleeve 25. The axial roller bearing 24 is held in its axial position by rings 26 and 27 attached, respectively, to rings 23 and 25 to function as relating rings. Thus, when force is exerted in an axial direction on adjusting sleeve 25, adjusting pistons 15 are simultaneously repositioned. The adjusting sleeve 25 has two cover plates 28 with bores between which is pivotably mounted a flat bar or link 29 by means of a bolt 30. Link 29 is part of a control lever 31, the arrangement of which will be described in connection with FIG. 3.

The inner area of the hub formed by inner housing 3 and modules 12 has several open spaces 45, which can be employed for drawing off motor or engine gases from the drive motor or engine for the watercraft. In such a case, the inner housing has a further sleeve 32 which is illustrated in FIG. 2. Alternatively, the structure can be provided with an end cap 33 as shown in FIG. 1 which terminates the hub.

Each adjusting piston 15 is guided in two coaxial bushings 34 and 35 which form a part of housing 11 at opposite ends thereof and are integrally connected to a hub cylinder 36. Thus, housing 11 comprises hub cylinder 36 which has an inwardly prottruding collar 37 and the two bushings 34, 35. On the side of this housing which faces toward the main drive shaft is a guide web 38 which is provided with a recess shaped and dimensioned so that it can be remobably mounted on one of the support rails 10 of bearing sleeve 9. Rails 10 and guides 38 form a positive, play-free connection.

Propeller hub 13 is connected by screws 39 to the base 40 of a propeller blade 17 and is guided on the inner collar 37 of hub cylinder 36 in both axial and radial directions. Because the propeller hub 13 moves slidingly with respect to inner collar 37 during the adjustment of the propeller blade pitch, the contacting surfaces thereof can be coated with a sliding or lubricating material. To be sure that propeller hub 13 and adjusting piston 15 occupy minimum space, the central portion of the piston is provided with a recess 41 which receives propeller hub 13 which receives adjusting pin 16 in the recess 14 forming the control path. When a propeller blade 17 is installed on one of modules 12, the blade with its propeller hub 13 is initially slipped into hub cylinder 36. Then, to permit the assembly of adjusting piston 15 into bushing 34, a semicircular diagonal recess (not shown) is povided in hub 13 and, during assembly, the hub is turned until the recess is aligned with bushings 34, 35, permitting piston 15 to be inserted therethrough. The propeller blade 17 is then turned until adjusting pin 16 can be introduced into groove 14 defining the control path. On the ends of piston 15 are provided elastic gaskets such as O-rings 42 and 43 which seal recess 41 from the outside, recess 41 being filled with a lubricant. The external sealing at propeller blade base 14 takes place on the bearing surface of inner collar 37 and by sealing screw 39 so that a completely closed space exists, insuring the lubrication of the sliding surfaces in the vicinity of collar 37.

The operation of this portion of the apparatus is believed to be clear from the above, but will be briefly reviewed. As piston 15 is moved axially with respect to bushings 35 and 34, pin 16 is caused to move axially, carrying with it groove 14 and causing propeller hub 13 to rotate within the space 41, thereby also rotating blade 17 and changing its pitch with respect to the axis of main drive shaft 1.

Figure 5:
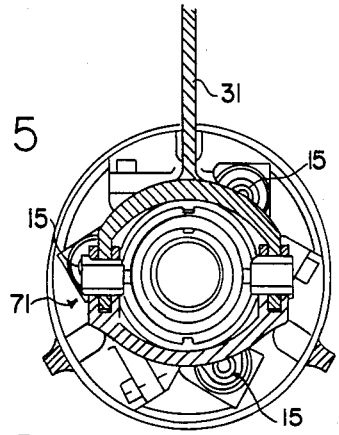
FIG. 5 is a tranverse sectional view along line IV—IV in FIG. 3.
Figure 6:
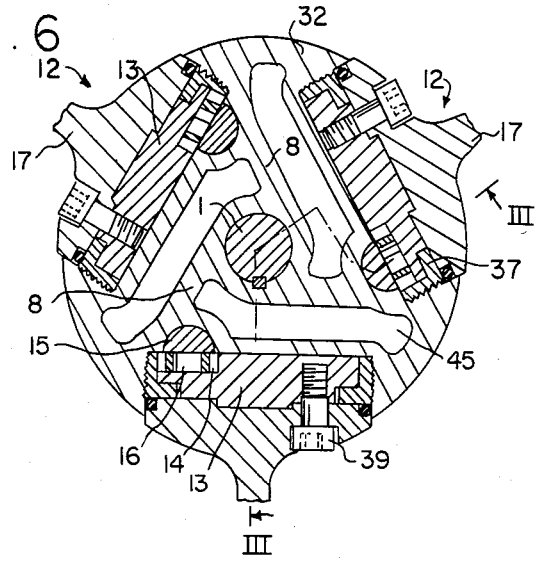
FIG. 6 is a transverse sectional view along line VI—VI in FIG. 3.

In FIGS. 3 to 6 two embodiments, similar to the embodiment of FIGS. 1 and 2 are shown, in which the outer housing modules 12 are integrally connected to the inner housing 3 by axially extending webs 49, see FIG. 6. In this case, inner housing 3, module 12 and outer sleeve 32 form a single body forming open spaces 45 for the passage of exhaust gases.

Equal references in FIGS. 3 to 6 as in FIGS. 1 and 2 signify equal parts and are no more explained in detail.

Figure 3:
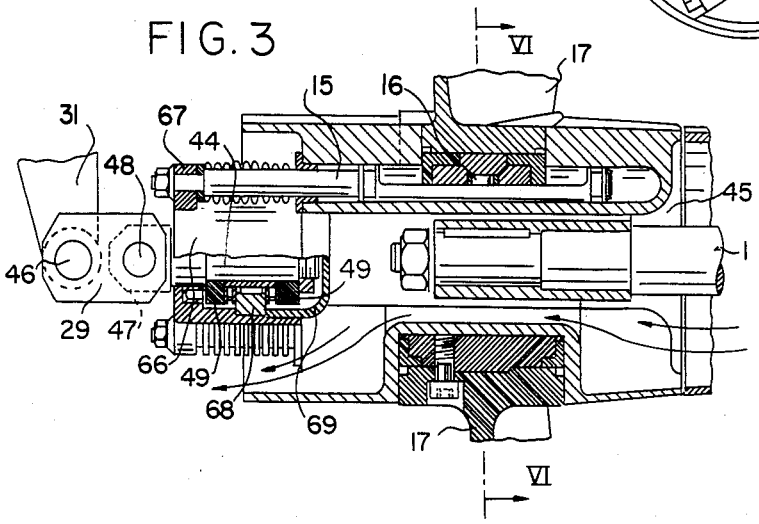
FIG. 3 is a side sectional view of a second embodiment of a controllable pitch propeller assembly in accordance with the invention.

In FIG. 3 three propeller blades 17 are arranged (only two visible) which are rotated by adjusting piston 15 (visible are one piston 15 in FIG. 3 and three pistons 15 in FIG. 5 and FIG. 6). For practical reasons (better force attack lever arm) the pistons 15 are spaced apart from the centre of base 40 of the blades 17. Piston 15 carries as in FIGS. 1 and 2 the adjusting pin 16 which is guided in path 14 of the propeller hub 13.

Figure 4:
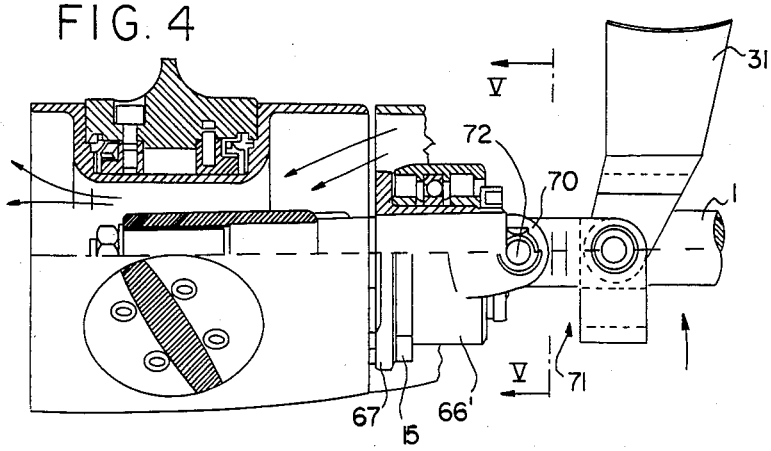
FIG. 4 is a side elevation, partly in section of a third embodiment of a controllable pitch propeller assembly in accordance with the invention.

FIGS. 3 and 4 show two variable pitch propellers adjusted by a control lever 31. The control lever 31 in FIG. 3 is situated on the trailing edge and in FIG. 4 on the leading edge of the propeller.

In FIG. 3 the non-rotating portions of the coupling between control lever 31 and pistons 15 contain link 29 fixed to lever 31 by a pin 46 and by a pin 48 to a cover platte 47, which is part of a shaft journal 44. Shaft journal 44 is the carrier of axial roller bearings 49. The bearings 49 are rotating parts and are encircled by a casing 66 having arms 67 for being connected to pistons 15 and axially fixed to bearings 49 by a bearing ring 68 supported by a cover 69 threaded with casing 66.

The passages for the exhaust gases are marked by thin arrows.

In FIGS. 4 and 5 the coupling of non-rotating and rotating parts is shown. The non-rotating casing 66' must encircle shaft 1 but has also arms 67 or a flange for the connection to pistons 15. The casing 66' has two coverplates 70, in which a yoke 71, see FIG. 5, is supported by a pin 72. The yoke 71 is the connection piece between casing 66' and control lever 31.

FIG. 6 shows the transverse section of the embodiment of FIG. 3. Between inner housing 3, outer housing 11 and axially extending webs 8 open spaces 45 are shown which can be used as passages for exhaust gases from the drive engine.

Figure 7:
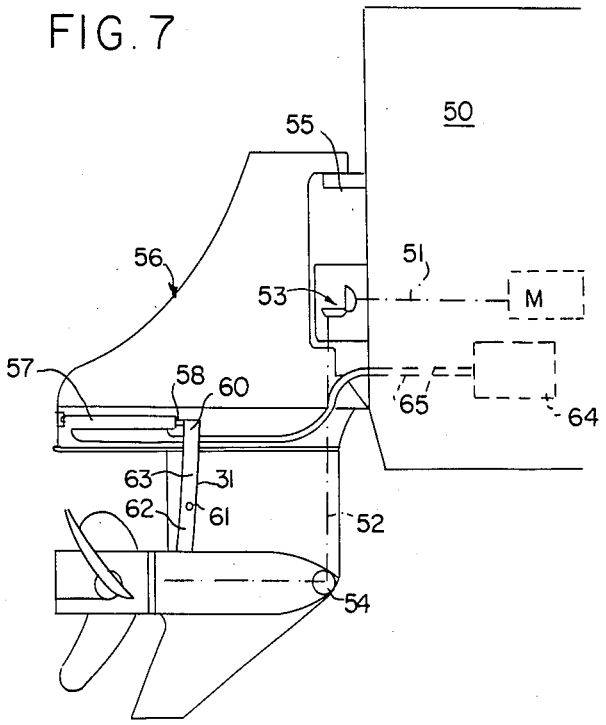
FIG. 7 is a side elevation of the rear portion of a watercraft having a drive assembly in accordance with the invention mentioned thereon.

FIG. 7 shows a complete drive for a watercraft with a controllable pitch propeller in accordance with the invention as shown in FIGS. 4 and 5. The controllable pitch propeller is driven by a schematically represented motor or engine M by means of a so-called Z-drive which is supported in the hull of watercraft 50. In this kind of a drive, main shaft 1 does not extend obliquely through the hull but, rather the torque is transmitted from the drive motor through shafts 51, 52 and bevel gears 53, 54 to main shaft 1. In the side view of FIG. 7, shafts 1, 51 and 52 form a roughly Z-like configuration. The controllable pitch propeller, together with shafts 1 and 52, is located in a rudder member 56 pivotable about the axis of a vertical pintle 55 supported at the end of the hull. Member 56 comprises several rudder parts, a casing and a bearing for the main shaft 1 which is not shown.

The adjustment device for adjusting the propeller blade 17 comprises a linear motor 57 which can be a hydraulic piston and cylinder assembly, the piston rod 58 of which is articulated to a swivel joint 60 of control lever 31. Lever 31 is formed as a double-armed lever with a central pivot 61, one arm 62 of this lever acting on adjusting sleeve 25 and the other arm 63 being acted upon through swivel joint 60 by linear motor 57. The linear motor can suitably be installed in rudder member 56, but it can also be arranged on either side thereof so long as precautions are taken to ensure the necessary symmetry for power transmission. The linear motor 57 is supplied with the necessary energy from a power source 64 through line 65 in a conventional fashion.

In FIG. 7 lever 31 is arranged at the leading edge of propeller blades 17. As it can be seen from FIGS. 4 and 5, there is sufficient space for the passage of exhaust gas, see the arrows in FIG. 4. As in FIG. 3 also in FIG. 4 a guide tube 73 can encircle shaft 1, casing 66 and yoke 71, leaving a slot for lever 31.

The damping effect of exhausted gas guided into the water of the propeller region is known. However, it is possible, to use it also for controllable pitch propellers.

What is claimed is:

1. A controllable variable pitch propeller assembly for driving a watercraft comprising a main drive shaft, outer housing means attached to the shaft for rotation therewith, a plurality of propeller blades, each blade having a propeller hub pivotally attached to said outer housing means so that the pivoting of each said hub adjusts the pitch of its associated blade, an inner housing connected to said outer housing means and extending longitudinally within said outer housing means around the axis of rotation of said drive shaft, said outer housing means and inner housing defining open spaces therebetween which extend through the length of said housings, an adjusting means spaced from said outer housing means, and means comprising a thrust bearing rotatable around said drive shaft axis for coupling the adjusting means to said propeller hubs without obstructing the flow of gas through said open spaces.

2. An assembly according to claim 1 wherein said outer housing means comprises a plurality of outer housing modules each having a mounting groove, and said inner housing has a plurality of axial extending support rails slidably engaging said mounting grooves.

3. An assembly according to claim 1 wherein each said outer housing body includes a hub cylinder for receiving one of said propeller hubs and first and second bushings on opposite sides of said hub cylinder having the axes thereof perpendicular to the hub cylinder axis and parallel to the long axis of said housing.

4. An assembly according to claim 3 wherein said coupling means also includes an adjustment piston axially movable in said bushings, said adjustment piston having a protruding adjustment pin, and wherein each said propeller hub includes an adjustment slot for receiving said adjustment pin whereby longitudinal movement of said piston causes pivotal movement of said hub.

5. An assembly according to claim 4 wherein said thrust bearing interconnects each said adjustment piston and said adjusting lever.

6. An assembly in accordance with claim 1 wherein said adjusting means comprises a double-armed lever having one arm engaging said thrust bearing, said assembly further including a linear motor, means for coupling said linear motor to the other arm of said lever, and means for mounting said linear motor on said watercraft in spaced relationship from said propeller blades.

7. An assembly according to claim 6 wherein said linear motor is a double-acting hydraulic piston and cylinder assembly mounted adjacent the hull of the watercraft.

8. An assembly according to claim 1 wherein each propeller hub is pivoted by a thurst rod drive.

9. An assembly according to claim 8 wherein each propeller hub has a rotating and a stationary portion and said thurst rod drives are connected to a connecting member situated between the rotating and stationary portion of the propeller hub.

10. An assembly according to claim 9 wherein said thrust drives each have a housing arranged singlely on the periphery of the outer housing means.

11. An assembly according to claim 8 wherein said open space gas passages are provided between the drive shaft and thrust rod driven propeller hubs.

12. An assembly according to claim 1 wherein said adjusting means comprises a lever spaced from said outer housing means on the inflow side of said propeller blades.

13. An assembly according to claim 1 wherein said adjusting means comprises a lever spaced from said outer housing means on the outflow side of said propeller blades.

14. An assembly according to claim 1 wherein said outer housing means and said inner housing are integrally connected.

* * * * *